United States Patent [19]

Avalle

[11] 4,033,149

[45] July 5, 1977

[54] LATCH CLOSER IN COMBINATION WITH A CLOSED LATCH DETECTOR

[75] Inventor: Angel C. Avalle, Pomona, Calif.

[73] Assignee: The Raymond Lee Organization, Inc., New York, N.Y. ; a part interest

[22] Filed: July 26, 1976

[21] Appl. No.: 708,908

[52] U.S. Cl. ..... 66/111; 66/157

[51] Int. Cl.[2] ..... D04B 35/18

[58] Field of Search ..... 66/157, 111

[56] References Cited

UNITED STATES PATENTS

| | | | |
|---|---|---|---|
| 2,658,366 | 11/1953 | Shelmire | 66/157 X |
| 3,659,437 | 5/1972 | McArthur et al. | 66/157 |
| 3,690,127 | 9/1972 | Tellerman et al. | 66/157 |
| 3,905,211 | 9/1975 | Raisin et al. | 66/157 |
| 3,906,752 | 9/1975 | Eichorst | 66/157 |
| 3,910,074 | 10/1975 | Parker | 66/157 |
| 3,946,578 | 3/1976 | Venzel | 66/157 |
| 3,987,649 | 10/1976 | Parker | 66/157 |

*Primary Examiner*—W. C. Reynolds
*Attorney, Agent, or Firm*—Howard I. Podell

[57] ABSTRACT

A device to stop a knitting machine when a needle hook has broken. The device consists of a directed blast of air at the needles of a knitting machine as the needles pass the point on the machine where an existing electronic detector device stops the machine upon indication that the needle latch is in the closed position. The blast of air raises the latch of a broken needle to the closed position to activate the detector. The latch of a needle in normal working order is restrained in the open position at the detector location by the action of a loop of yarn about the latch and is not affected by the blast of air. With a needle controlled to form a tuck stitch a broken needle hook which fails to catch a loop of yarn will result in an open latch condition which does not activate any detector in a conventional machine equipped only with a closed latch detector.

2 Claims, 12 Drawing Figures

LATCH CLOSER IN COMBINATION WITH A CLOSED LATCH DETECTOR

SUMMARY OF THE INVENTION

My invention is a device to stop a knitting machine when a needles hook has broken. The device consists of a directed blast of air at the needles of a knitting machine as the needles pass the point on the machine where an existing electronic detector device stops the machine upon indication that the needle latch is in the closed position. The blast of air raises the latch of a broken needle which had been cammed or controlled to form a tuck stitch to the closed position to activate the detector. The latch of a needle in normal working order is restrained in the open position at the detector location by the action of a loop of yarn about the latch and is not affected by the blast of air. A broken needle hook which fails to catch a loop of yarn will result in an open latch condition which does not activate any detector in a conventional machine equipped only with a closed latch detector.

By means of my invention, a knitting machine equipped with my invention and the conventional closed latch detector of the machine will also serve as a broken needle hook detector and shut off a machine with a broken needle hook to prevent waste of defective knitted yarn.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
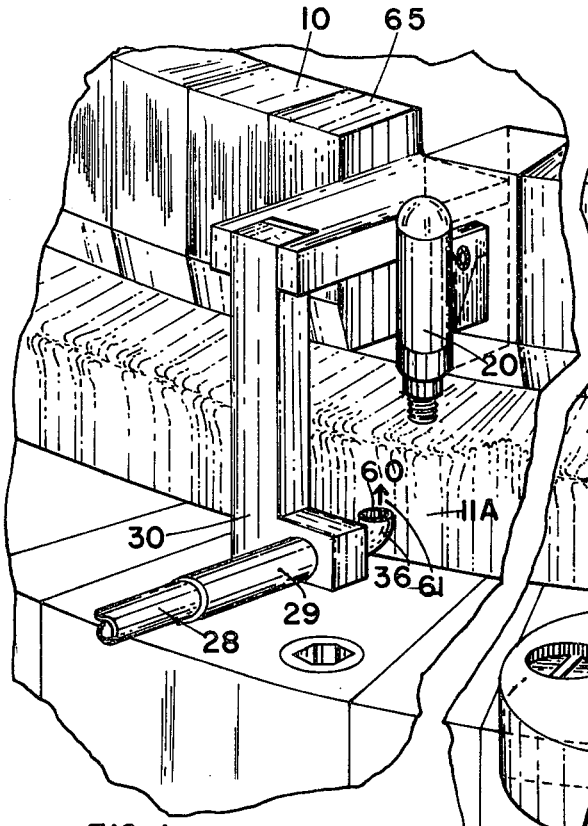
FIG. 1 is a perspective view of the invention in use directed at a cylinder needle.
Figure 2:
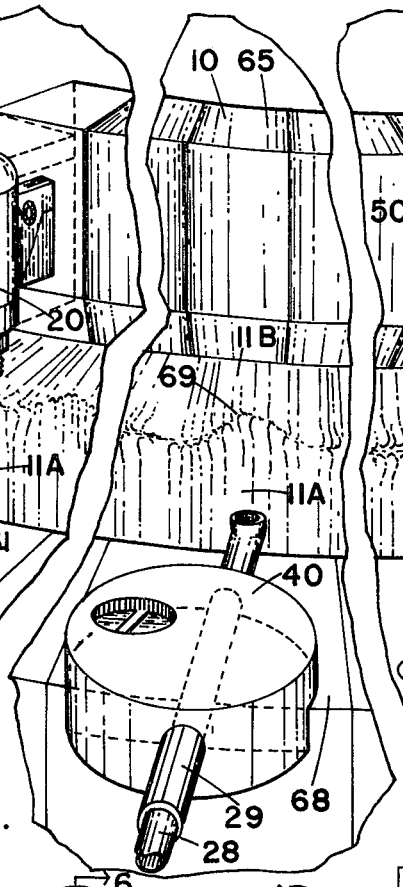
FIG. 2 is a perspective view of an alternate embodiment of the cylinder needle blower.
Figure 3:
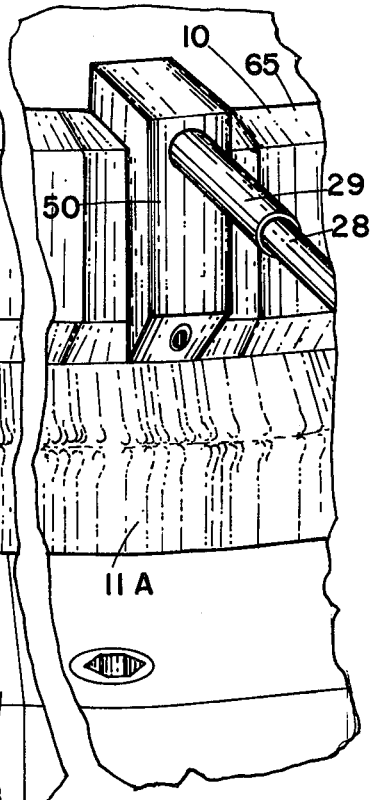
FIG. 3 is a perspective view of the invention installed as a dial needle blower.
Figure 4:
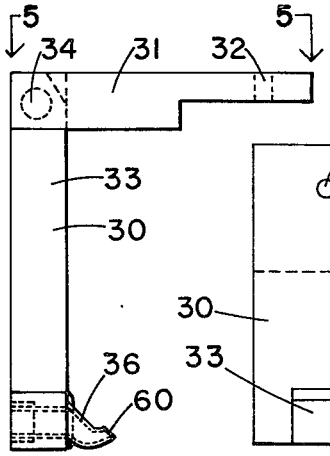
FIG. 4 is a side view of the cylinder blower.
Figure 5:
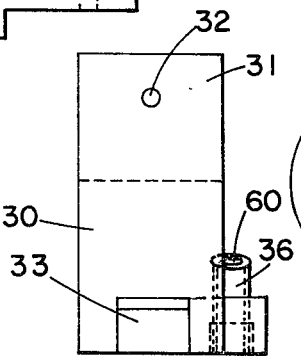
FIG. 5 is a plan view of the cylinder blower; taken along line 5—5 of FIG. 4.
Figure 6A:
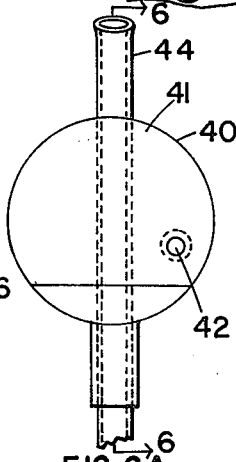
FIG. 6A is a plan view of the alternate embodiment of the cylinder blower.
Figure 6B:
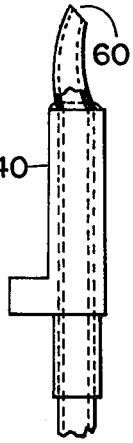
FIG. 6B is a side view of the alternate embodiment of the cylinder blower; taken along line 6—6 of FIG. 6A.
Figure 7A:
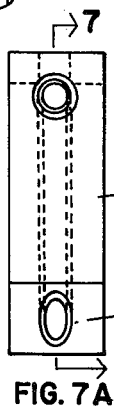
FIG. 7A is an elevation view of the dial blower.
Figure 7B:
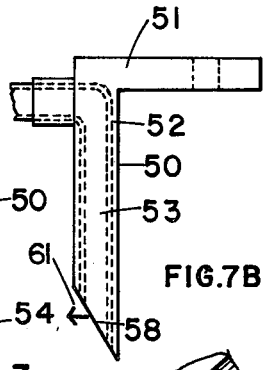
FIG. 7B is a side view of the dial blower; taken along line 7—7 of FIG. 7A.
Figure 8:
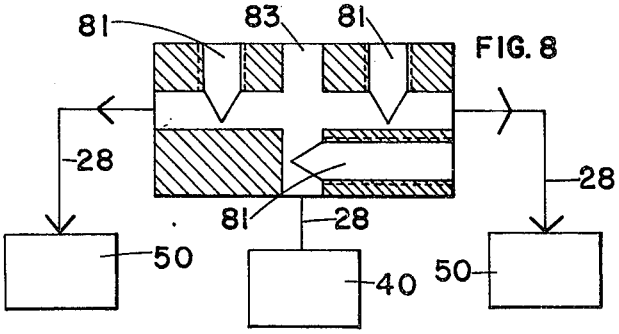
FIG. 8 is a sectional schematic view of the air distributor of the invention.

Turning now descriptively to the drawings, in which similar reference characters denote similar elements throughout the several views, FIG. 1 illustrates a conventional knitting machine 10 fitted with conventional cylinder needles 11A and dial needles 11B mounted on a rotatable frame (not shown) which reciprocates the cylinder needles 11A vertically and the dial needles 11B horizontally as the rotatable frame revolves.

Figure 9:
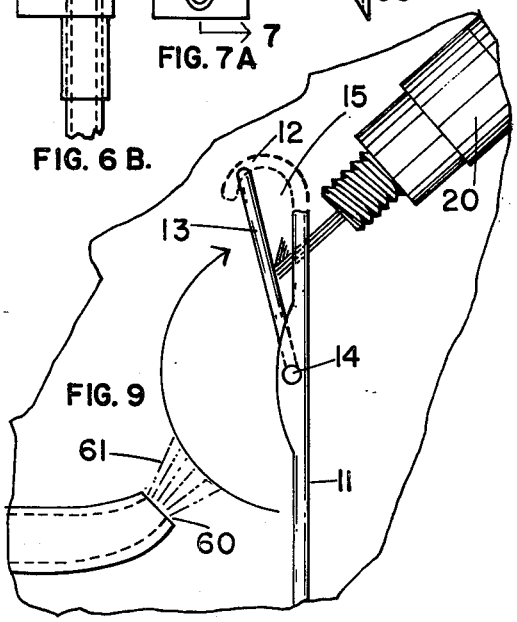
FIG. 9 is a side view of the invention in operation, detecting a broken needle hook.
Figure 10:
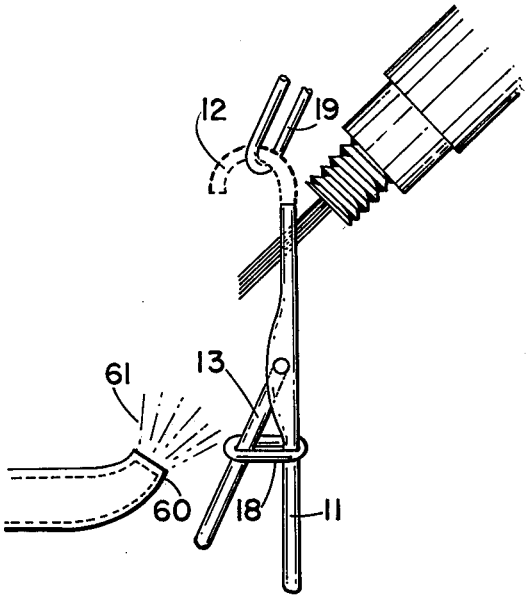
FIG. 10 is a side view of the invention in operation, passing an unbroken needle.

The needles 11A and 11B are of similar shape to needle 11, shown in FIGS. 9-10, and are each formed at their free end as a hook 12, with a latch 13 pivotally mounted by pin 14 to needle 11 to permit latch 13 to rotate to a first closed position, shown in FIG. 9, in which the latch 13 encloses the recess 15 bounded by hook 12, to a second open position, shown in FIG. 10 in which the latch 13 is rotated free of engagement with hook 12 so as to open recess 15 bounded by hook 12.

Knitting machine 10 is conventionally equipped with a closed latch detector 20 mounted on the machine 10 in a position to scan the needles 11A and 11B at the needle position in which latch 13 is in the normally open position to detect whether latch 13 has defectively remained in the closed position. Detector 20 is fitted with circuitry to detect the latch position, when closed, and to cause machine 10 to stop upon detection of a defective latch in the closed position. However, such conventional detectors 20 do not detect the presence of a broken hook section 12.

By means of my invention, which is the installation of a unit 30, 40 or 50 that directs a stream of air against the latch 13 of the needles 11A and 11B at the location of detector 20, the latch 13 of a needle 11 previously controlled to form a tuck stitch, of which the hook 12 is broken, will automatically be rotated by the blast of air 61 from the open position, shown in FIG. 10, to the closed position, as shown in FIG. 9, to activate electronic detector 20 to stop machine 10, and prevent manufacture of defective fabric (not shown). As shown in FIG. 10, the unbroken hook 12 of needle 11 in the tuck position of the needle 11, hooks a loop 18 of thread about latch 13, to restrain latch 13 in the open position as the hook 12 engages a second loop 19 of thread. Air blast 61 from nozzle 60 does not affect the open position of latch 12 since it is restrained by loop 18. With hook 12 broken, as shown in FIG. 9, the latch of a needle cammed or controlled to form a tuck stitch will remain open after the lael-formed loop has been cast off and since there is no restraining loop 18 about latch 13, the blast 61 of air from nozzle 60 of the invention rotates latch 13 to the closed position to activate detector 20.

Unit 30 is adaptable for mounting to the fixed base 65 of machine 10, above needles 11A and 11B, with a first arm 31 fitted with a mounting hole 32 and hinged to a second arm 33 by pin 34. Second arm 33 serves as a mount for a nozzle 36, the mouth portion 60 of which is shaped to direct a stream of air 61 along the axial direction of cylinder needle 11A towards the latch 13 and hook 12 so as to blow an unrestrained latch 12 to the closed position, shown in FIG. 9.

Unit 40 is adaptable alternately for mounting to the fixed base platform 68 to below the juncture 69 of needles 11A and 11B and is formed of a solid disc 41 fitted with a mounting hole 42 and enclosing a tube 44, the nozzle mouth 60 of which is directed axially along cylinder needles 11B.

Unit 50 is mounted to the fixed base 65 of the machine above dial needles 11B and is formed of a bar formed with a mounting arm 51 joined at right angles to a free arm 52, with free arm 52 bored with an axial hole 53 terminating at an end face 54 of free arm, with the plane of end face 54 at an angle to the axis of hole 53 and free arm 52, so as to direct a stream of air 61 through outlet 58 hole 53 along the axis of dial needles 11B towards the hook end of the dial needles.

Nozzle 36 of unit 30, tube 44 of unit 40 and hole 53 of unit 50 are each fitted with a detachable collar 29 for attachment to a flexible air supply hose 28.

Units 30 or 40 and unit 50 are mounted to machine 10 in a position adjacent to electronic detector 20 so that a latch 13 blown by the air stream 61 of such a unit to a closed position will remain in the closed position as the rotatable frame rotates the needles past detector 20, when the hook of the needle is broken.

All air supply hoses 28 may be joined to a common distribution unit 80 fitted with individual pressure regulators 81 for individually regulating the pressure from a supply connection 83 to each supply hose 28.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A unit attachable to a knitting machine for the purpose of rotating the open latch of a knitting needle with a broken hook which had been previously controlled to form a tuck stitch to a closed position so as to trigger sensing equipment of the machine that is set to detect a latch in the closed position, said unit in the form of a mount to which an air nozzle is fixed, said nozzle fitted with means to attach to a supply of pressurized air, and said nozzle shaped to blow air axially along said knitting needle of the machine towards the hook end of the said needle to close said latch before it passes said sensing equipment, said mount fitted with means to attach to said machine.

2. The combination as recited in claim 1 in which the said unit is mounted on a knitting machine proximate to the position of sensing equipment set to detect a needle latch in the closed position.

* * * * *